US005850768A

United States Patent [19]

Chow

[11] Patent Number: 5,850,768

[45] Date of Patent: Dec. 22, 1998

[54] PLIERS FOR GRIPPING WORKPIECES OF DIFFERENT SIZES

[76] Inventor: Jessie Chow, No. 288, Hou Juan Road, Taichung, Taiwan

[21] Appl. No.: 791,454

[22] Filed: Jan. 27, 1997

Related U.S. Application Data

[63] Continuation-in-part of Ser. No. 524,638, Sep. 7, 1995, Pat. No. 5,660,089.

[51] Int. Cl.[6] ..... B25B 7/04

[52] U.S. Cl. ..... 81/413; 81/409.5; 81/427

[58] Field of Search ..... 81/385, 407, 408, 81/409.5, 411, 413, 417, 427, 427.5, 342, 355, 356, 357

[56] References Cited

U.S. PATENT DOCUMENTS

| | | | |
|---|---|---|---|
| 434,409 | 8/1890 | Sutton et al. | 81/427 |
| 561,340 | 6/1896 | Rice | 81/413 |
| 883,237 | 3/1908 | Reif, Jr. | 81/409.5 |
| 2,144,180 | 1/1939 | Cruickshank | 81/427 |
| 3,232,152 | 2/1966 | Miller | 81/408 |
| 4,651,598 | 3/1987 | Warheit . | |
| 4,662,252 | 5/1987 | Warheit . | |

*Primary Examiner*—D. S. Meislin
*Assistant Examiner*—Joni B. Danganan
*Attorney, Agent, or Firm*—Charles E. Baxley, Esq.

[57] ABSTRACT

A pair of pliers includes a handle member having an intermediate portion slidably engaged in an intermediate portion of another handle member which has a rack located closer to the handle end. A pawl is pivotally secured on the handle member for engaging with the rack so as to secure the intermediate portions of the handle members together when the jaw ends are engaged with the workpiece. Two panels and a plate are pivotally mounted between the first and second handle members, and a torsion spring is mounted between the two panels to provide a reliable operation.

1 Claim, 5 Drawing Sheets

PLIERS FOR GRIPPING WORKPIECES OF DIFFERENT SIZES

Cross-References to Related Applications

This is a continuation-in-part application of Applicant's U.S. patent application Ser. No. 08/524,638 filed on Sep. 7, 1995 now U.S. Pat. No. 5,660,089.

BACKGROUND OF THE INVENTION

1. Field of the Invention

The present invention relates to a utility plier for gripping workpieces of different sizes, and more particularly to a utility plier having an improved arrangement to avoid elastic fatigue of the torsion spring in applicant's U.S. patent application Ser. No. 08/524,638.

2. Description of the Related Art

A wide variety of pliers have heretofore been provided, and some examples are U.S. Pat. No. 4,651,598 to Warheit and U.S. Pat. No. 4,662,252 to Warheit. In some conventional pliers, the pliers include longitudinal slots in the handle members thereof which would greatly reduce the strength of the handle members and such that the pliers would be easily damaged. Applicant's U.S. patent application Ser. No. 08/524,638 discloses a pair of pliers in which the handle members thereof are non-channeled to increase the strength. Nevertheless, elastic fatigue of the spring 353 biased between the panels 35 and 36 might occur due to abrasion under long-term usage.

The present invention is intended to provide an improved utility plier which mitigates and/or obviates the above problem.

SUMMARY OF THE INVENTION

A pair of pliers in accordance with the present invention comprises first and second members including first and second non-channeled jaw ends, first and second handle ends and first and second intermediate portions formed between the first and the second jaw ends and the first and the second handle ends respectively. The first intermediate portion of the first handle member includes a pair of parallel planar members for slidably receiving the second intermediate portion of the second handle member therebetween. The first intermediate portion of the first handle member includes a rack means located closer to the first handle end and includes a contact surface means located closer to the first jaw end. The second handle member includes a stop means secured on the second jaw end thereof for engaging with the contact surface means and for preventing the second intermediate portion from disengaging from the first intermediate portion.

Means for biasing the second jaw end away from the first jaw end is provided. In addition, a pawl means is pivotally secured on the second intermediate portion and includes a toothed end for engaging with the rack means and includes a contact end for engaging with the rack means and for preventing the toothed end from engaging with the rack means. Furthermore, means for biasing the contact end of the pawl means to engage with the rack means is provided.

Two panels are pivotally coupled to the first handle end of the first handle member. A plate is pivotally coupled to the second end of the second handle member and is pivotally coupled between the panels at a shaft. The plate includes a curved slot having a curvature located at the shaft. Each panel includes a protrusion extending therefrom and slidably engaged with the curved slot so as to limit a rotational movement between the panels and the plate. Each panel includes a rounded relatively thicker section through which the shaft extends. Each panel further includes a stub extending therefrom and facing each other.

A torsion spring is mounted between the stubs. The torsion spring includes a first end attached to the first handle member and a second end attached to the hook portion of the plate.

The second jaw end is moved away from the first jaw end so as to grip a workpiece of large size. The stop means is caused to engage and to move along the contact surface means when the first and the second handle ends are moved toward each other in order to move the first and the second jaw ends toward each other so as to grip the workpiece. The second handle member is moved relative to the first handle member so as to rotate the pawl means in order to engage with the toothed end with the rack means and so as to secure the first and the second intermediate portions together when the first and the second jaw ends grip the workpiece therebetween.

Other objects, advantages, and novel features of the invention will become more apparent from the following detailed description when taken in conjunction with the accompanying drawings.

DESCRIPTION OF THE PREFERRED EMBODIMENT

Figure 1:
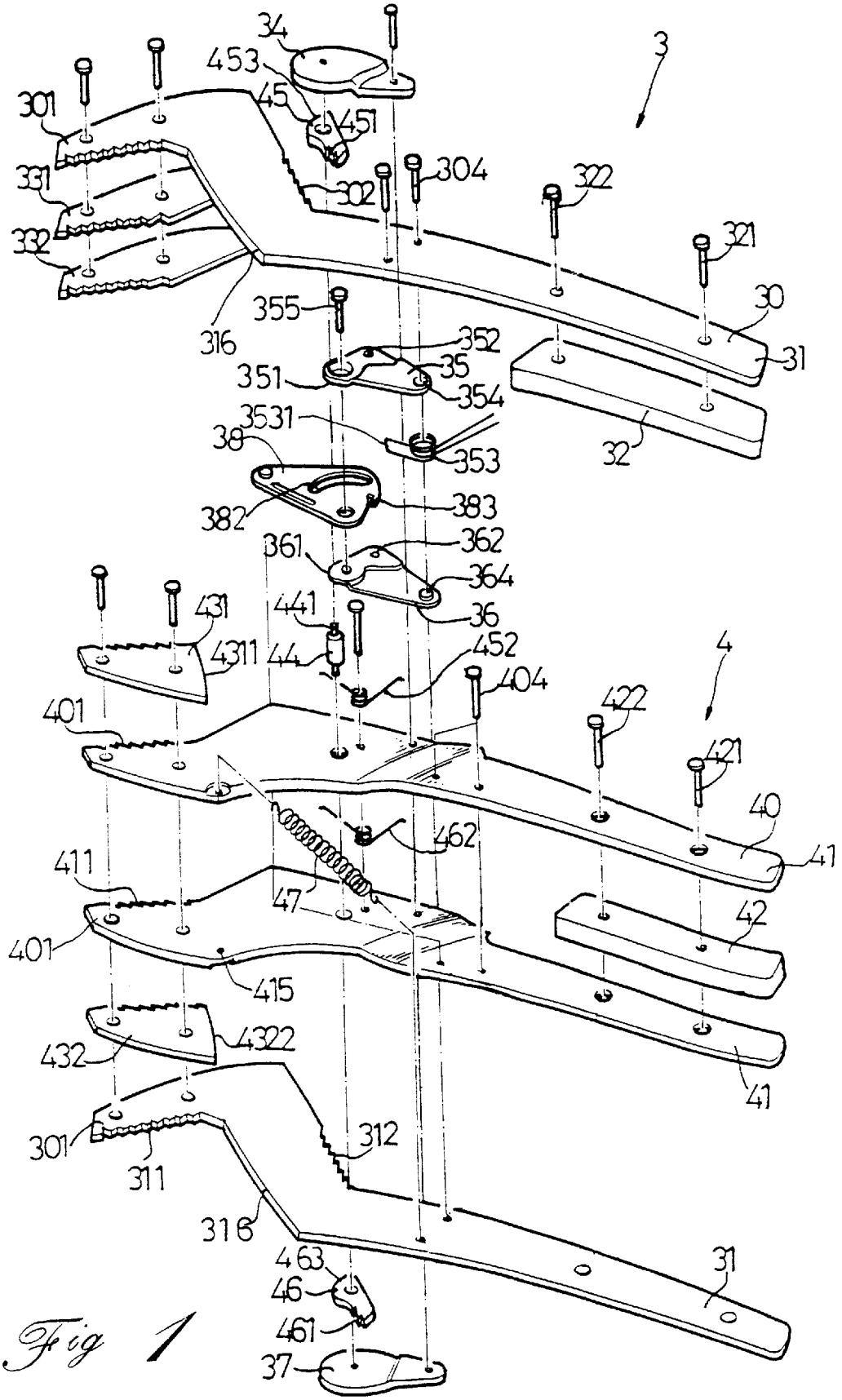
FIG. 1 is an exploded perspective view of a utility plier in accordance with the present invention.
Figure 2:
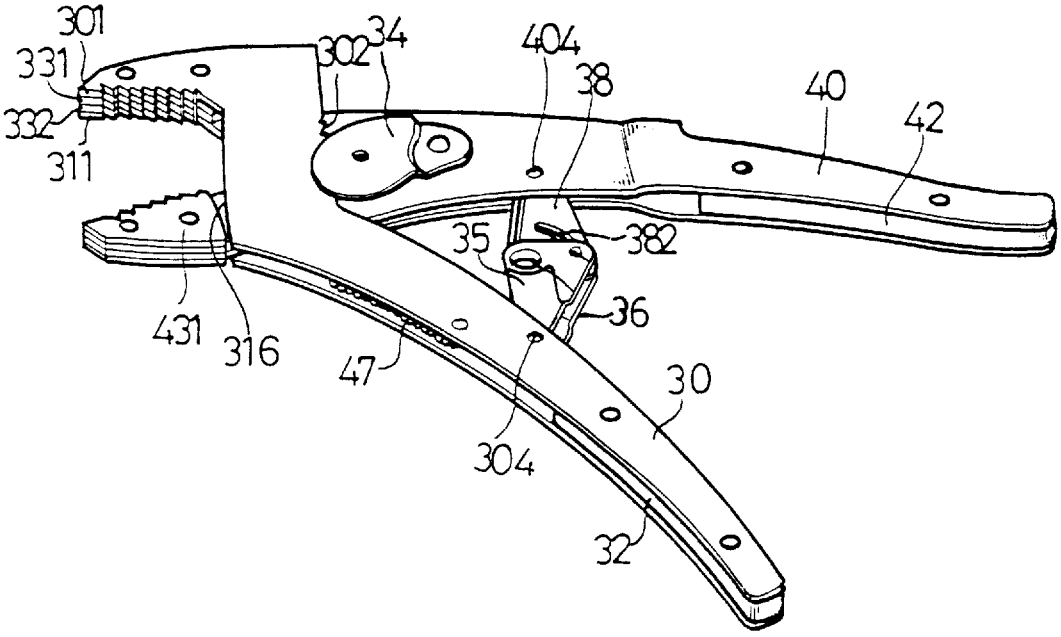
FIG. 2 is a perspective view of the utility plier.
Figure 3:
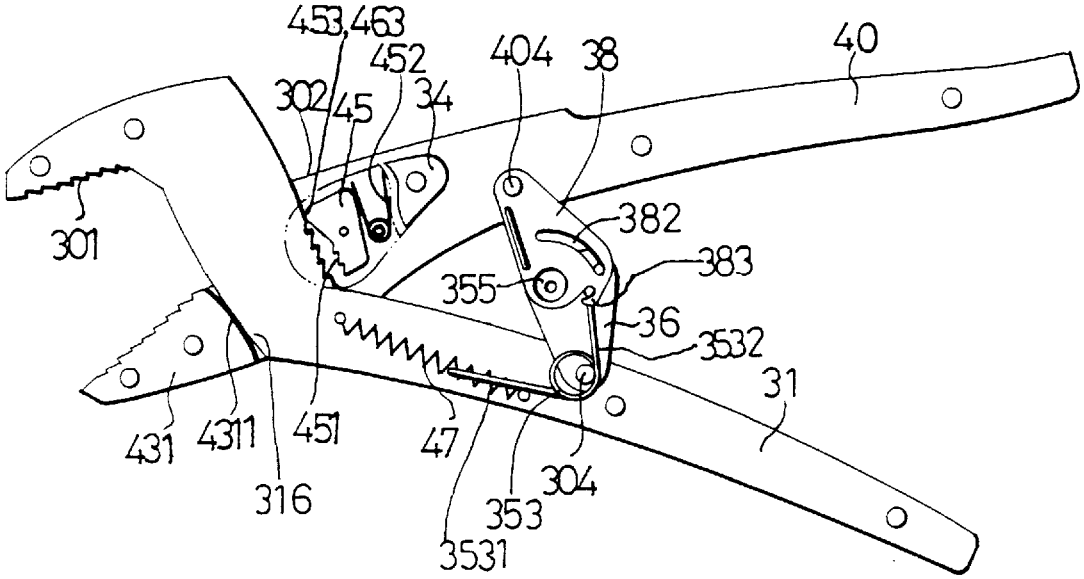
FIG. 3 is a plane view of the utility plier in which a panel thereof is removed for clarity.

Referring to the drawings and initially to FIGS. 1 to 3, a utility plier in accordance with the present invention comprises a pair of parallel handle members 30, 40 each including a jaw end, a handle end, and an intermediate portion. In this embodiment, the handle member 30 includes two planar members 31 which, in turn, have two spacers 331 and 332 fixed between jaw ends 301 thereof and which have a spacer 32 secured between handle ends thereof by rivets 321, 322. The jaw end 301 of each planar member 31 includes a number of teeth 311 defined thereon for engaging with a workpiece. Each planar member 31 further includes a rack 302, 312 formed in one edge of an intermediate portion thereof and located closer to the handle end. Each planar member 31 further includes a contact surface 316 located closer to the jaw end 301.

The handle member 40 also includes two planar members 41 which, in turn, have a spacer 42 fixed between handle ends thereof by rivets 421 and 422 and which have two stops 431, 432 fixed on jaw ends 401 thereof. The jaw end 401 of each planar member 41 includes a number of teeth 411 defined in therein for engaging with the workpiece, together with the jaw ends 301 of the handle member 30. The stops 431, 432 each includes a contact edge 4311, 4322 for engaging with the respective contact surface 316 of the handle member 30 and for preventing the jaw ends 401 from disengaging from the handle member 30.

As best shown in FIGS. 2 and 3, the intermediate portion of the handle member 40 is slidably engaged between the intermediate portions of the planar members 31 of the handle member 30. A spring 47 is coupled between the intermediate portion of the handle member 40 and the handle end of the handle member 30 so as to bias the jaw end of the handle member 40 away from the jaw end of the handle member 30. A rod 44 is fixed in the intermediate portion of the handle member 40 and includes two ends 441 extended therefrom. A pair of pawls 45 and 46 are pivotally coupled to the rod 44 and are respectively engaged on both sides of the handle member 40 and each includes a toothed end 451, 461 for engaging with the respective rack 302, 312. A pair of covers 34 and 37 are secured to the intermediate portion of the handle member 30 and are respectively secured to the ends 441 of the rod 44 for covering the pawls 45 and 46. A pair of springs 452, 462 are biased between the covers 34, 37 and the pawls 45, 46 for biasing rounded contact ends 453, 463 of the pawls 45, 46 to engage with the racks 302, 312, best shown in FIGS. 3 and 4.

A plate 38 has one end pivotally coupled to the handle member 40 by an axle 404 and has a curved slot 382 defined therein. The plate 38 further includes a hook portion 383 which will be explained later. A pair of panels 35 and 36 each has one end pivotally coupled to the handle member 30 by an axle 304 and are pivotally coupled to the plate 38 at a shaft 355 and have a protrusion 352, 362 formed thereon. The protrusion 352, 362 extends into the curved slot 382 so as to slide therealong. The curved slot 382 of the plate 38 has a curvature center located at the shaft 355 such that the panels 35, 36 and the plate 38 may be rotated relative to each other about the shaft 355. The sliding engagement of the protrusions 352, 362 in the curved slot 82 may limit the rotational movement between the panels 35, 36 and the plate 38. In this embodiment, each panel 35, 36 includes a rounded relatively thicker section 351, 361 through which the shaft 355 extends. In addition, each panel 35, 36 includes a stub 354, 364 extending therefrom and facing each other so as to mount a torsion spring 353 therebetween. As shown in FIGS. 1 and 3, the torsion spring 353 is mounted between the stubs 354 and 364 and around the axle 304. The torsion spring 353 includes a first end in the form of an elastic band 3531 bearing against pin 3533 on the handle member 30 and a second end 3532 attached to the hook portion 383 of the plate 38.

When not in use, as shown in FIGS. 2 and 3, the spring 47 biases the jaw ends of the handle members 30, 40 away from each other, and the rounded contact ends 453, 463 of the pawls 45, 46 of the pawls 45, 46 are biased to engage with the racks 302, 312 by the springs 452, 462. The axle 404, the shaft 355, and the axle 304 are in alignment with one another.

Figure 4:
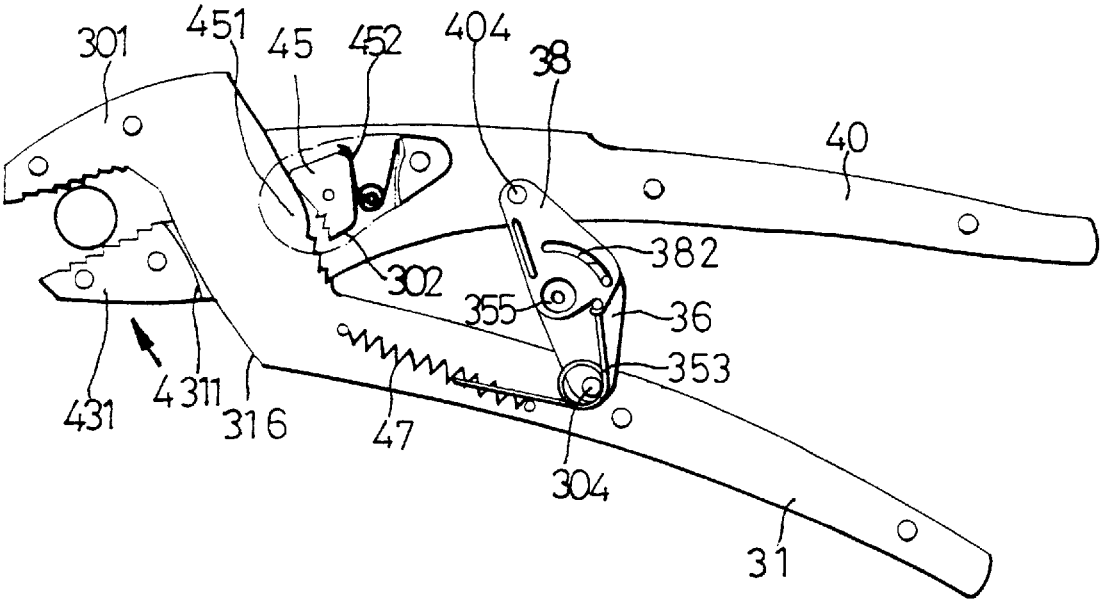
FIGS. 4 and 5 are plane views illustrating operation of the utility plier in which a panel thereof is removed for clarity.

When gripping a workpiece, as shown in FIG. 4, the jaw ends of the handle members 30, 40 are slightly moved toward each other against the spring 47 to hold the workpiece. It is appreciated that the axle 404, the shaft 355, and the axle 304 are not in a straight line. At this moment, the contact edges 4311, 4322 of the stops 431, 432 engage with the contact surfaces 316 of the handle member 30. The springs 452, 462 urge the pawls 45, 46 to move toward the racks 302, 312.

Figure 5:
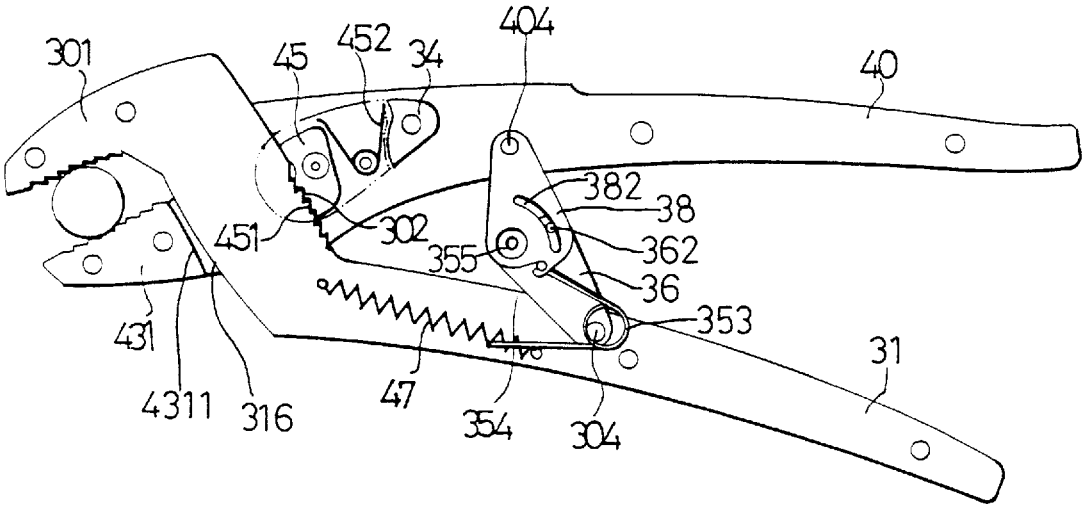

As shown in FIG. 5, when the handle ends of the handle members 30, 40 are further pulled toward each other, the axle 404, the shaft 355, and the axle 304 are in an obtuse angle. The spring 47 is extended when applying force to the handle members 30, 40. The contact edges 4311, 4322 of the stops 431, 432 disengage from the contact surfaces 316 of the handle member 30. In the meantime, the springs 452, 462 urge the pawls 45, 46 to engage with the racks 302, 312. In addition, the panels 35, 36 are forced to rotate relative to the plate 38 about the shaft 355 and the protrusions 352, 362 slide along the curved slot 382 of the plate 38. The torsion spring 353 is in torsion, as shown in FIG. 5. At this moment, the workpiece is firmly gripped between the jaw ends of the handle members 30, 40.

According to the above description, it is appreciated that the risk of elastic fatigue of the torsion spring 353 is greatly reduced and thus may provide a reliable and durable utility plier.

Although the invention has been explained in relation to its preferred embodiment, it is to be understood that many other possible modifications and variations can be made without departing from the spirit and scope of the invention as hereinafter claimed.

What is claimed is:

1. A pair of pliers, comprising:

first and second handle members including first and second non-channeled jaw ends, first and second handle ends and first and second intermediate portions formed between said first and said second jaw ends and said first and said second handle ends respectively, said first intermediate portion of said first handle member including a pair of parallel planar members for slidably receiving said second intermediate portion of said second handle member therebetween, said first intermediate portion of said first handle member including a rack means located closer to said first handle end and including a contact surface means located closer to said first jaw end, said second handle member including a stop means secured on said second jaw end thereof for engaging with said contact surface means and for preventing said second intermediate portion from disengaging from said first intermediate portion;

spring means for biasing said second jaw end away from said first jaw end;

a pawl means pivotally secured on said second intermediate portion and including a toothed end for engaging with said rack means and including a contact end for engaging with said rack means and for preventing said toothed end from engaging with said rack means;

means for biasing said contact end of said pawl means to engage with said rack means;

two panels pivotally coupled to said first handle end of said first handle member, a plate pivotally coupled to said second handle end of said second handle member and pivotally coupled between said panels at a shaft, said plate including a curved slot having a curvature located at said shaft, each said panel including a protrusion extending therefrom and slidably engaged with the curved slot so as to limit a rotational movement between said panels and said plate, each said panel including a rounded relatively thicker section through which the shaft extends, each said panel further including a stub extending therefrom and facing each other; said plate further including a hook portion;

a torsion spring mounted between the stubs, the torsion spring including a first end attached to the first handle member and a second end attached to the hook portion of the plate;

said second jaw end being moved away from said first jaw end so as to grip a workpiece of large size, said stop means being caused to engage and to move along said contact surface means when said first and said second handle ends are moved toward each other in order to move said first and said second jaw ends toward each other so as to grip the workpiece, said second handle member being moved relative to said first handle member so as to rotate said pawl means in order to engage with said toothed end with said rack means and so as to secure said first and said second intermediate portions together when said first and said second jaw ends grip the workpiece therebetween.

* * * * *